US005141325A

United States Patent [19]

Huang

[11] Patent Number: 5,141,325

[45] Date of Patent: Aug. 25, 1992

[54] LAMP WITH COLLAPSIBLE ARM

[76] Inventor: James C. S. Huang, No. 19, Lane 111, Ho Ping Rd., Juchou, Taipei Hsien, Taiwan

[21] Appl. No.: 757,187

[22] Filed: Sep. 10, 1991

[51] Int. Cl.[5] ..... F21S 1/12

[52] U.S. Cl. ..... 362/413; 362/411; 362/414; 362/419; 362/427

[58] Field of Search ..... 362/285, 287, 410, 413, 362/414, 419, 427, 411

[56] References Cited

U.S. PATENT DOCUMENTS 2,740,039 3/1956 Phillips ..... 362/413

4,706,172 11/1987 Lebowitz ..... 362/413 X

*Primary Examiner*—Stephen F. Husar

*Attorney, Agent, or Firm*—Bacon & Thomas

[57] ABSTRACT

The present invention is aimed to provide a lamp with collapsible arm, the collapsible arm comprises bottom, intermediate, and top sections telescopedly connected to each other, and a conductive assembly disposed in the sections to facilitate electrical communication therebetween, so that the collapsible arm can be adjusted to a desired position by way of moving the sections forward and backward without losing electric contact therebetween.

5 Claims, 5 Drawing Sheets

LAMP WITH COLLAPSIBLE ARM

BACKGROUND OF THE INVENTION

The present invention relates to lamps, particularly to a lamp with a collapsible arm in which a conductor assembly is disposed permitting forward and backward movement of the arm while maintaining electrical contact.

The design trend of lamps, such as those used on a table or the floor, has adopted a movable arm instead of fixed one to adjust the lamp to a desired position.

The conventional types of lamp often use pivotally jointed arms, rotatable in either two or three dimensions. In these configurations, the wire for transmitting electric current is not varied when changing the position of the arm.

However, in accordance of the present invention, a novel arm arrangement is proposed, which utilizes a telescopic connection to adjust the lamp position.

SUMMARY OF THE INVENTION

It is an objective of the present invention to provide a lamp with a collapsible arm.

It is another objective of the present invention to provide a collapsible arm which comprises telescopically connected sections and a conductor assembly disposed in the sections to selectively adjust the position of the lamp as desired.

Other advantages and objectives will be appreciated in view of the disclosure with reference to the appended drawings, in which like numerals denote like elements or parts.

DETAILED DESCRIPTION OF THE PREFERRED EMBODIMENT

Figure 1:
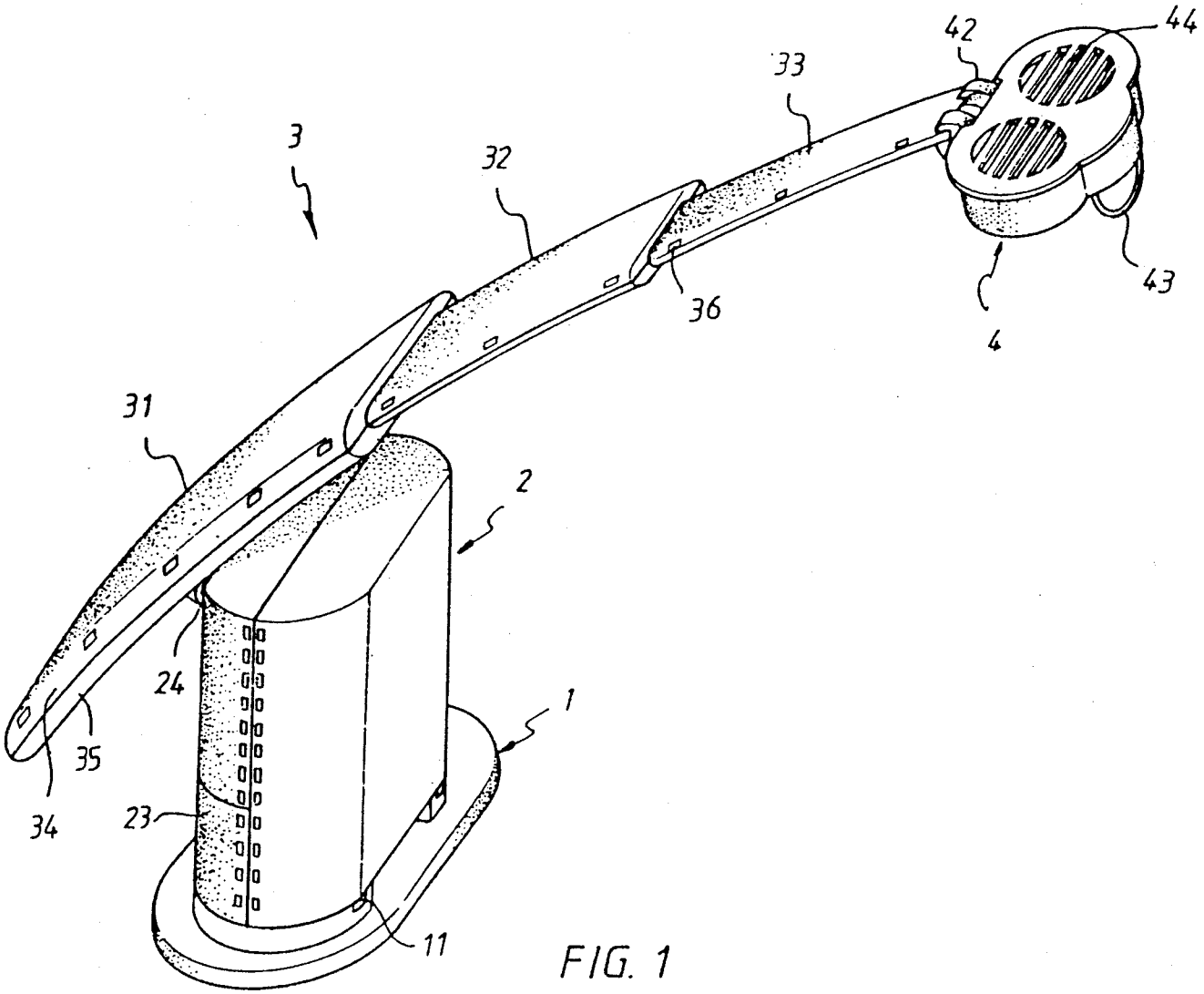
FIG. 1 is a perspective view showing a lamp with collapsible arm according to the present invention.

Referring generally to the drawings, in particular to FIG. 1, there is shown a lamp with a collapsible arm, which generally comprises a base 1, a transformer box 2, a collapsible arm 3, and a lampshade 4.

Figure 2:
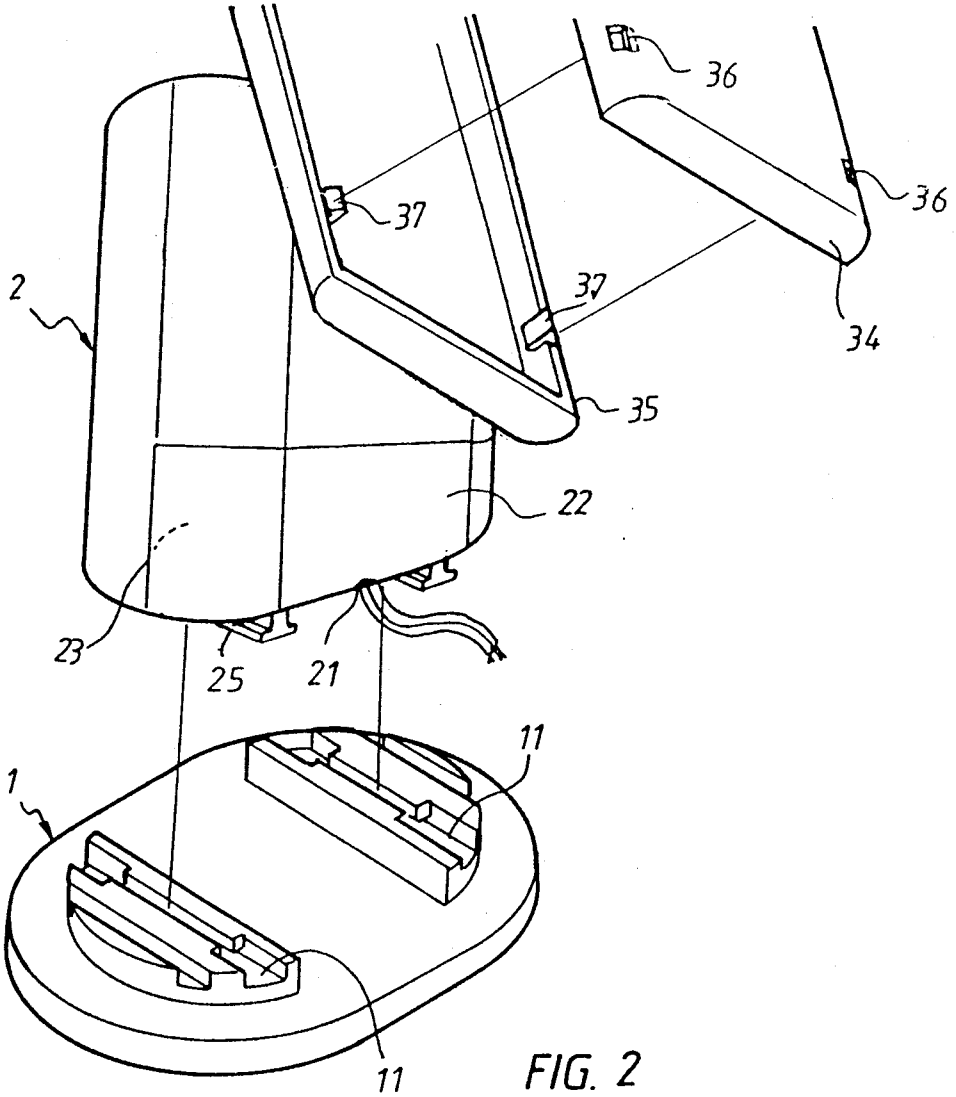
FIG. 2 is a partial, exploded, perspective view showing the assembly of the lamp of FIG. 1.

FIG. 2 shows the connection of the transformer box 2 on the base 1, provided with a weight for counterbalancing, which includes a covering member 22 in registration with the base. Mounted in the covering member 22 is an electrical wire box 23, in which wires are accommodated. The wires extend out of the wire box 23 through opening 21 to a power source (not shown).

The transformer box 2 further has pair of inverted T-shaped rails 25 adapted to be engaged with a pair of T-shaped slots 11 defined on the base 1.

Shown in FIGS. 1, 2, 3, and 4 is the collapsible arm 3, which is composed of three sections: bottom section 31; intermediate section 32; and top section 33, each of which is slidably connected. This will be explained in detail hereinbelow.

Each section has an upper cover 34 and a lower cover 35 detachably engaged with each other. Typically, as shown particularly in FIG. 2, the lower cover 35 has barb-like protrusions 37 in registration with recesses in the upper cover 34.

The bottom section 31 and intermediate section 32 both have an opening 39 formed on a front portion such that the bottom section 31 receives the intermediate section 32 through the opening, and similarly, the intermediate section 32 receives the top section 33 via the opening 39. As a result, the sections can be telescopically connected to adjust the length of the collapsible arm as desired.

Figure 4:
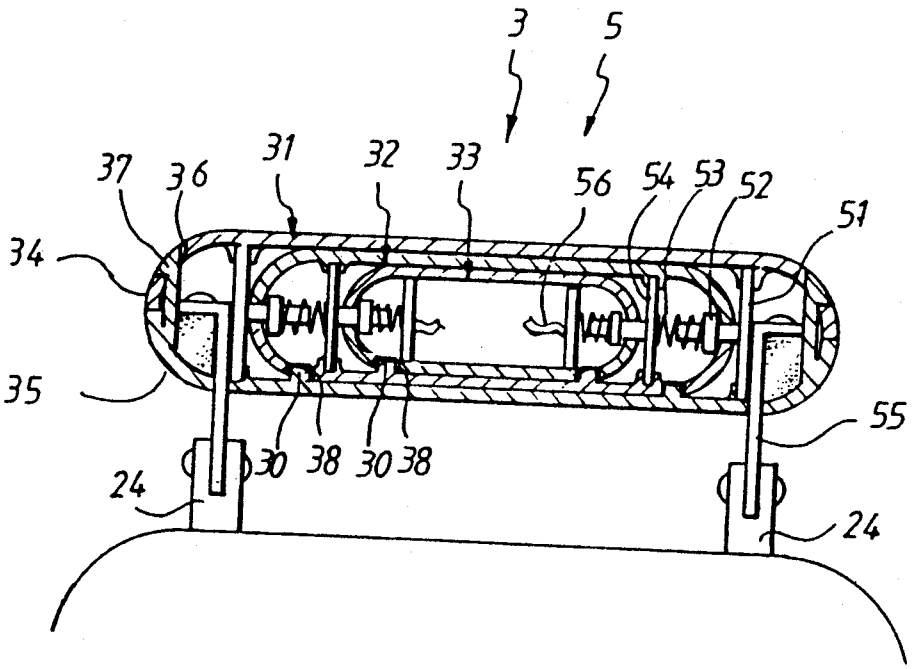
FIG. 4 is a lateral cross-sectional view showing the connection of the collapsible arm of FIG. 3; and, FIG. 5 is a schematic view showing the arrangement of conducting posts and springs seated on the posts in electrical communication with the conductive rails used in the collapsible arm according to the present invention.

In order to supply the electric power from the power source to the lamp and avoid tangling of the wires, the conductor assembly 5 is provided. This is best illustrated in FIG. 4.

The conductor assembly 5 for transmitting electric current from a power source to the lamp 41 of the lampshade, comprises a pair of L-shaped members 55 pivotally connected to electric terminals 24 in electric contact with first conducting rails 51 disposed in the bottom section 31, respectively. Second conducting rails 54 disposed in the intermediate section 32 are electrically in contact with the first conducting rails 51.

Figure 5:
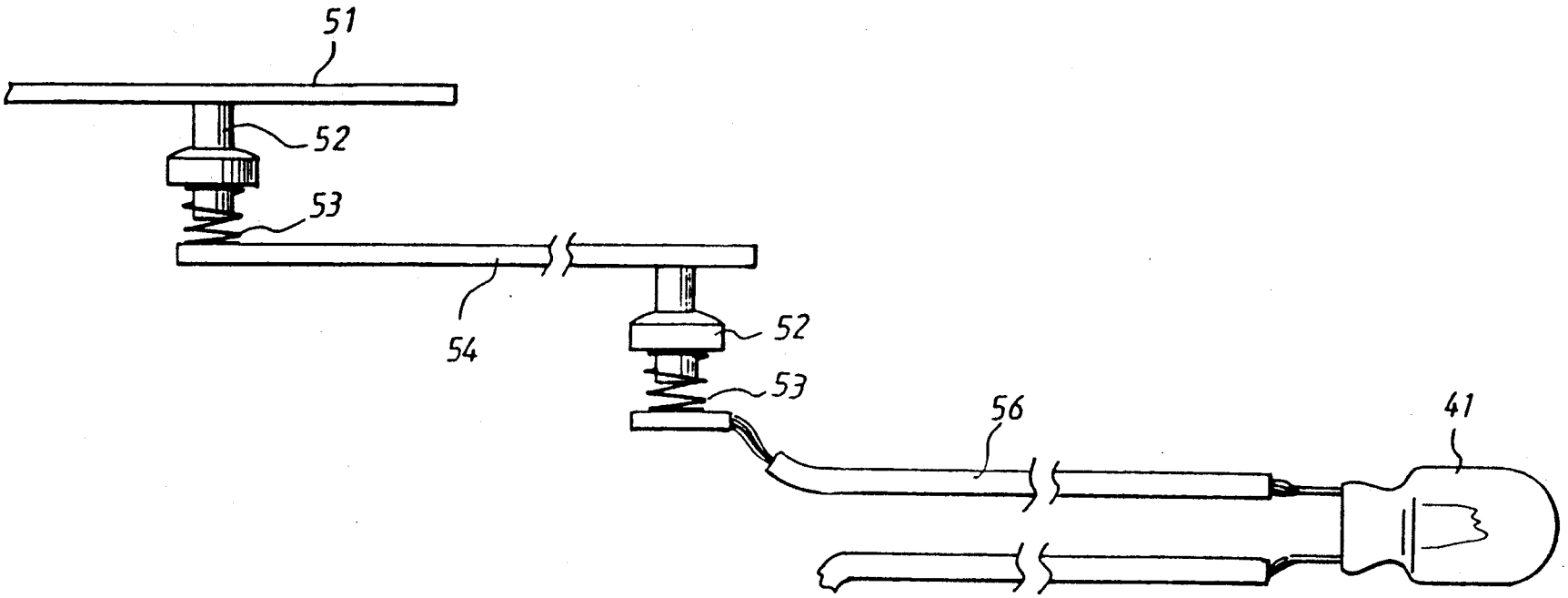

Further, in reference to FIG. 5, a pair of conducting posts 52 respectively slidably contact the first conducting rails 51. As clearly depicted in FIG. 5, a spring 53 seated on post 52 is in contact with and biased against the second conducting rail 54 which permits the electric current to flow from the first conducting rails 51 to the second conductive rails 54. Consequently, when the collapsible sections are to be telescopically adjusted for a desired length or position, the posts 52 in combination with the springs 53 electrically communicate between the first and second conducting rails 51 and 54.

Similarly, posts and springs seated on the post, also respectively designated by reference numerals 52 and 53, slidably contact the second conductive rails 54 and are in electrical communication with wires 56 supply electric power to the lamp 41.

With this arrangement, the electrical current received from the power source can be transmitted from terminals 24 via the conductor assembly 5 to the lamp 41.

It is noted that, although the posts 52 are slidably connected to one rail according to one embodiment of the present invention, it is to be understood that the electrical communication can be modified with both conducting post ends being slidably connected to rails by placing a sleeve with a proper step portion to abut the spring located between the sleeve and the post.

The lampshade 4 is pivoted to the top section 33, as designated by reference numeral 42 and has a pulling tab or ring portion 43 formed on the front portion to facilitate adjusting the position of the lampshade.

Figure 3:
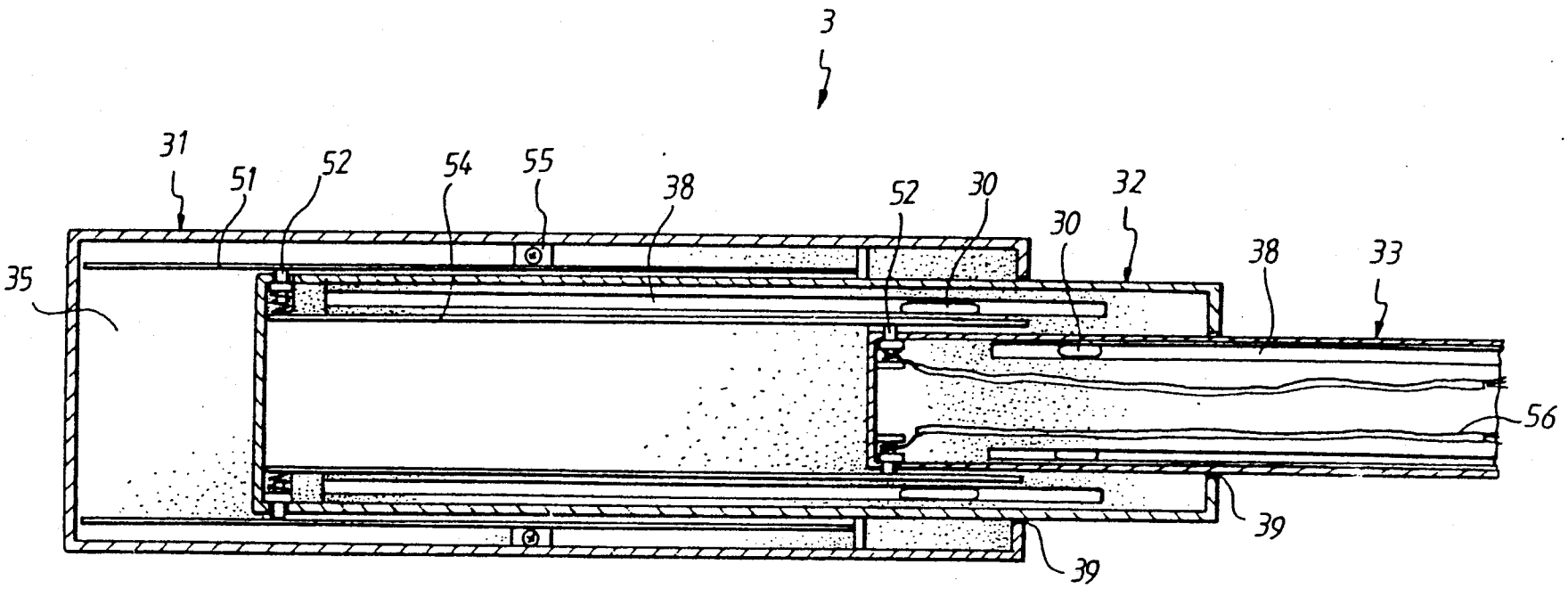
FIG. 3 is a longitudinal cross-sectional view showing the collapsible arm of the lamp according to the present invention.

Turning now to the FIGS. 3 and 4, in order to facilitate the forward and backward movement between the sections of the collapsible arm 3, a pair of guiding slots 38 can be formed, for example, on the intermediate section 32 and the top section 33, in which a pair of guides 30 are disposed, in registration with the slots, in the bottom section 31 and intermediate section 32, respectively. As a consequence, the guides 30 can travel between the distal limits of the slots 38. That is to say, the sections of the arm 3 can be adjusted to a desired length as permitted by the nature of the slots and guides engagement.

In view of the above, the present invention has fully disclosed the novel features of the collapsible arm associated with the lamp that permits the adjustment of the lamp in a desired position. Other modifications readily apparent to those skilled in the art are viewed as violation of the present invention.

What is claimed is:

1. An adjustable lamp comprising:

a) a base having a transformer box thereon;

b) a collapsible and extendable arm comprising:

i) a bottom section having first upper and lower cover members;

ii) an intermediate section slidably received in the bottom section and having second upper and lower cover members;

iii) a top portion slidably received in the intermediate portion and having third upper and lower cover members;

iv) a first pair of conducting rails located within the bottom section so as to be enclosed by the first upper and lower cover members;

v) a second pair of conducting rails located within the intermediate section so as to be enclosed by the second upper and lower cover members;

vi) first means electrically connecting the first and second pair of conducting rails;

vii) electrical conductors located within the top section so as to be enclosed by the third upper and lower cover members; and, viii) second means electrically connecting the second pair of conducting rails to the electrical conductors in the top section;

c) pivot attachment means pivotally attaching the bottom section to the transformer box and electrically connecting the first pair of conducting rails to a source of electrical power;

d) a light assembly attached to the top section, the light assembly including a light bulb; and, e) third means electrically connecting the light bulb to the electrical conductors in the top section.

2. The adjustable lamp of claim 1 wherein the light assembly is pivotally attached to the top section.

3. The adjustable lamp of claim 1 wherein the first means electrically connecting the first and second pair of conducting rails comprises:

a) a pair of first posts attached to the intermediate section; and, b) a pair of first electrically conductive spring means in electrical contact with the pair of first posts and the second pair of conducting rails, the pair of first spring means biasing the pair of first posts into electrical contact with the pair of first conducting rails.

4. The adjustable lamp of claim 3 wherein the second means electrically connecting the second pair of conducting rails to the electrical conductors in the top section comprises:

a) a pair of second posts attached to the top section; and, b) a pair of second electrically conductive spring means in electrical contact with the electrical conductors in the top section and biasing the pair of second posts into electrical contact with the pair of second conducting rails.

5. The adjustable lamp of claim 1 further comprising a pull tab attached to the light assembly to facilitate adjustment of the lamp.

* * * * *